US006323588B1

(12) United States Patent
Lilljedahl et al.

(10) Patent No.: US 6,323,588 B1
(45) Date of Patent: Nov. 27, 2001

(54) LOCKING CLIP FOR A LAMP BASE HAVING FIRST, SECOND AND THIRD PORTIONS

(75) Inventors: Donald W. Lilljedahl, Pittsfield; Howard D. Taggart, Gilford; Robert B. Dolan, Manchester, all of NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/357,027

(22) Filed: Jul. 20, 1999

Related U.S. Application Data

(60) Provisional application No. 60/095,445, filed on Aug. 5, 1998.

(51) Int. Cl.[7] ..... H01J 5/48; H01J 5/50

(52) U.S. Cl. ..... 313/318.1; 313/573; 313/634; 313/318.9; 439/611; 439/615

(58) Field of Search ..... 313/57, 993, 573, 313/634, 572, 579, 318.01, 318.03, 318.04, 318.09, 318.1; 362/61, 226; 439/611, 615; 24/563, 67.9; 411/198, 202, 203, 211, 221, 316, 317, 322

(56) References Cited

U.S. PATENT DOCUMENTS

| | | | | |
|---|---|---|---|---|
| 4,920,463 | * | 4/1990 | Montet | 362/61 |
| 5,381,070 | | 1/1995 | Tuttle et al. | 313/318 |
| 5,521,460 | * | 5/1996 | Zhu | 313/318.09 |
| 5,550,422 | | 8/1996 | Sulcs et al. | 313/25 |

FOREIGN PATENT DOCUMENTS

| | | | |
|---|---|---|---|
| 0698902 | 2/1996 | (EP) | H01J/5/60 |
| 2136201 | 9/1984 | (GB) | H01K/1/34 |
| 2160579 | 12/1985 | (GB) | F16B/2/20 |

* cited by examiner

*Primary Examiner*—Vip Patel
*Assistant Examiner*—Mack Haynes
(74) *Attorney, Agent, or Firm*—William H. McNeill

(57) ABSTRACT

A locking clip 10 for fixing a base to an end of a glass bulb. The locking clip 10 has a body 12 with a first portion 14, a middle portion 16 and an end portion 18. The middle portion 16 is scyphate, i.e., cup-shaped, and defines a plane, 20 (FIG. 2). The first portion 14 extends away from plane 20 in a given direction by an angle α, which, in a preferred embodiment, is about 5 degrees. The end portion 18 is connected to the middle portion 16 by a reentrant section 22 and extends away from the plane 20 by an angle β in a direction opposite to the given direction. In a preferred embodiment angle β is preferably about 20 degrees. In a still more preferred embodiment the included angle between first portion 14 and end portion 18 is between 25 and 35 degrees. A centrally located aperture 24 is provided in the reentrant section 22 to aid in the subsequent bending of the end portion 18 at the final welding.

4 Claims, 4 Drawing Sheets

LOCKING CLIP FOR A LAMP BASE HAVING FIRST, SECOND AND THIRD PORTIONS

This application claims priority from Provisional Application No. 60/095,415, filed Aug. 5, 1998.

TECHNICAL FIELD

This invention relates to a locking clip and more particularly to a locking clip for a lamp base.

BACKGROUND ART

There are several known techniques for securing a screw base onto a lamp outer jacket. The latter generally takes the form of a glass bulb. One conventional method is to mold a threaded area on the lower or base portion of the outer jacket glass so that a screw base can be threaded thereon. During the formation of the threads an indentation also is made near the top thereof. When the lamp is being completed, one of the in-lead wires of the lamp is pressed into a lead solder slug and the lead solder slug is inserted into the indentation. The base is threaded onto the lamp over the lead solder slug, heat is applied, and the solder joint is completed. This operation electrically connects one of the lamp in-leads to the base and mechanically holds the base onto the glass bulb of the outer jacket. A significant problem with this basing technique is that the lead solder can pose an environmental problem when the lamp is disposed of, as well as creating a manufacturing hazard during the production of the lamp.

Recently, other techniques have been proposed to alleviate the hazards in the use of the lead solder. Among these techniques are those shown in U.S. Pat. Nos. 5,381,070 and 5,521,460 (these two patents being assigned to the assignee of the instant invention) and U.S. Pat. No. 5,550,422. While all of these approaches solved the problem of lead solder usage, they introduced other concerns.

For example, the solution represented by U.S. Pat. No. 5,550,422 has the undesirable requirement that the base clip must be physically attached to the lamp by snapping it onto the bottom seal of the lamp. This provides an additional step in the manufacturing process. Further, the clip is attached to an area of the glass that is normally more fragile. The area at the bottom can have sharper angles and residual stress that make the area susceptible to glass fracture. By attaching the clip to this area, glass fractures can occur both during lamp manufacture or when the lamp is be extracted from a tight socket.

The methods shown in U.S. Pat. Nos. 5,381,070 and 5,521,460 avoid these problems by making the mechanical and electrical connection through a clip that is not attached to the bottom seal of the lamp. However, a disadvantage of these two designs is that the clip has sharp edges. These sharp edges are in contact with the glass in the area where the base is mechanically secured to the lamp. When a torque is applied to the base, for example, during extraction from a socket, the sharp edges impinge on the glass and place a high-localized pressure on the glass. This pressure can achieve levels that are sufficient to fracture the glass. This is an undesired potential failure mode because the lamp jacket can separate from the base, leaving a base with sharp glass fragments in the socket. It is also possible that such a failure mode will expose the lamp electrical circuit, thus creating the risk of an electrical shock.

Another issue occurring with the designs of U.S. Pat. Nos. 5,381,070 and 5,521,460 is that they can create an outward protrusion that extends outwardly past the base shell by more than 0.050 inches, a distance that exceeds ANSI specifications. The outward extension of the clips of these patents have a straight portion that is normally bent over the base shell during the basing operation, typically forming a radius at the clip-to-shell interface. This radius, also, can often be too large and form a protrusion that is beyond the ANSI specification.

DISCLOSURE OF INVENTION

It is, therefore, an object of this invention to obviate the disadvantages of the prior art.

It is another object of the invention to enhance the base-to-clip junction of lamps.

Yet another object of the invention is the provision of base-to-clip junction that reduces stresses in the lamp.

Still another object of the invention is a lamp that will not fracture easily during removal from a tight socket.

These objects are accomplished, in one aspect of the invention, by a locking clip for fixing a base to an end of a glass bulb, the locking clip comprising a body having a first portion, a middle portion and an end portion, with the middle portion being scyphate and defining a plane. The first portion extends away from the plane in a given direction by an angle of about 5 degrees. The end portion is connected to the middle portion by a reentrant section and extends away from the plane in a direction opposite the given direction by an angle of about 20 degrees. The scyphate middle portion extends the full width of the clip and thus provides only softly curving surfaces in contact with a groove in the glass.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
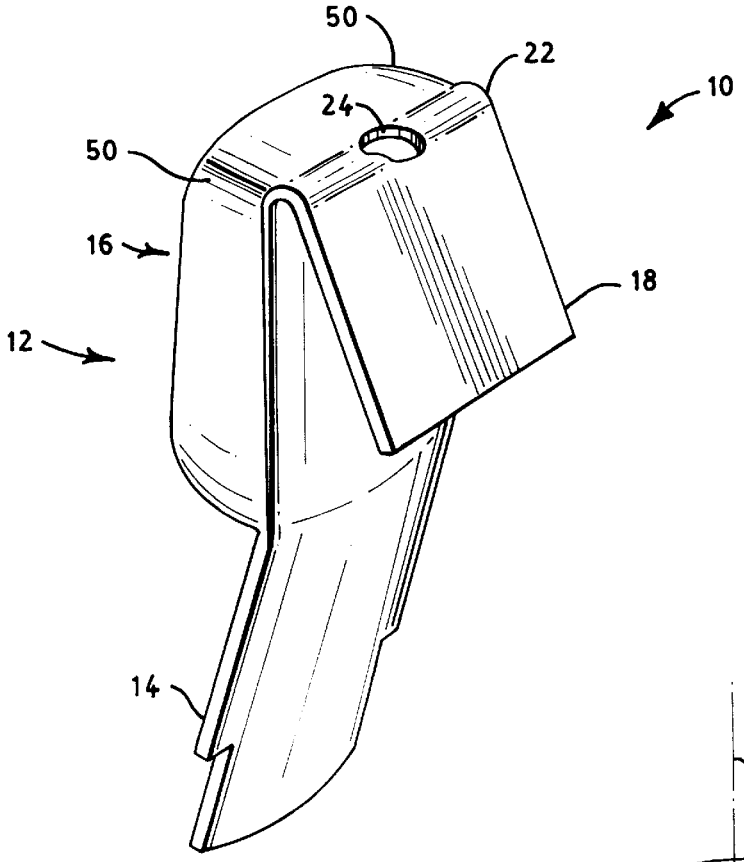
FIG. 1 is a perspective view of an embodiment of a clip of the invention.
Figure 2:
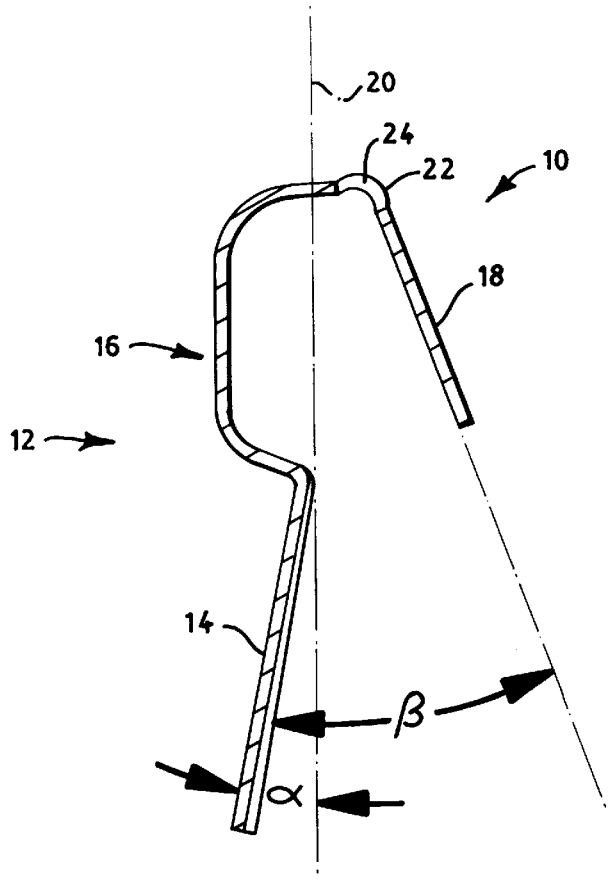
FIG. 2 is an elevational view of the clip, in section.

Referring now to the drawings with greater particularity, there is shown in FIGS. 1 and 2 a locking clip 10 for fixing a base to an end of a glass bulb. The locking clip 10 has a body 12 with a first portion 14, a middle portion 16 and an end portion 18. The middle portion 16 is scyphate, i.e., cup-shaped, and defines a plane, 20 (FIG. 2). The first portion 14 extends away from plane 20 in a given direction by an angle $\alpha$, which, in a preferred embodiment, is about 5 degrees. The end portion 18 is connected to the middle portion 16 by a reentrant section 22 and extends away from the plane 20 by an angle $\beta$ in a direction opposite to the given direction. In a preferred embodiment angle $\beta$ is preferably about 20 degrees. In a still more preferred embodiment the included angle between first portion 14 and end portion 18 is between 25 and 35 degrees. A centrally located aperture 24 is provided in the reentrant section 22 to aid in the subsequent bending of the end portion 18 at the final welding.

Figure 3:
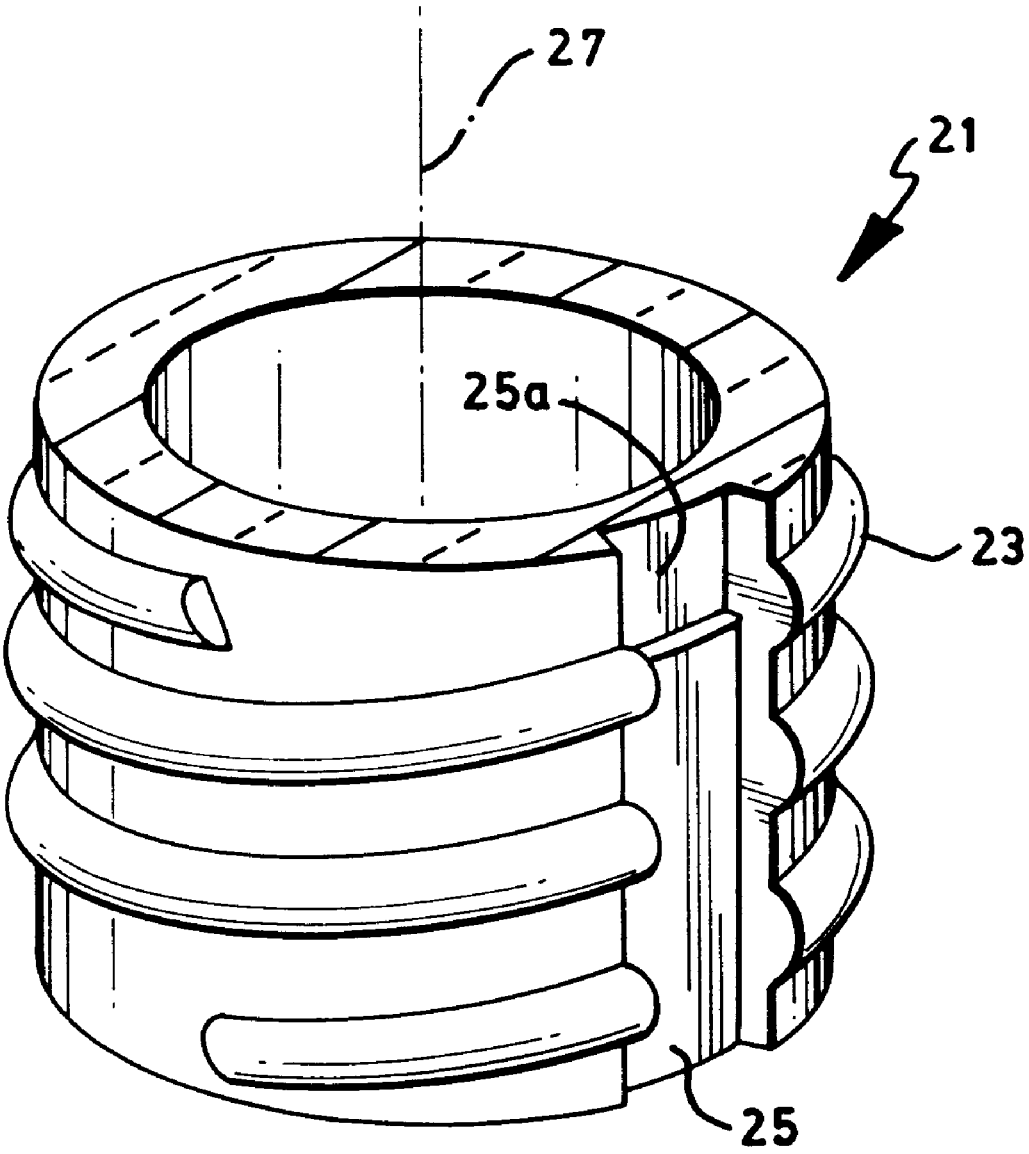
FIG. 3 is a partial perspective view of the base of lamp illustrating the lead-in wire receiving groove.

Referring now to FIG. 3 there is shown the bottom 21 of a glass bulb or envelope 30. Bottom 21 is provided with threads 23 and a lead-in wire receiving groove 25. The upper part of groove 25 is provided with a receiving port 25*a* for accepting the scyphate middle portion 16 of clip 10. The bottom 21 is arranged about a longitudinal axis 27.

Figure 4:
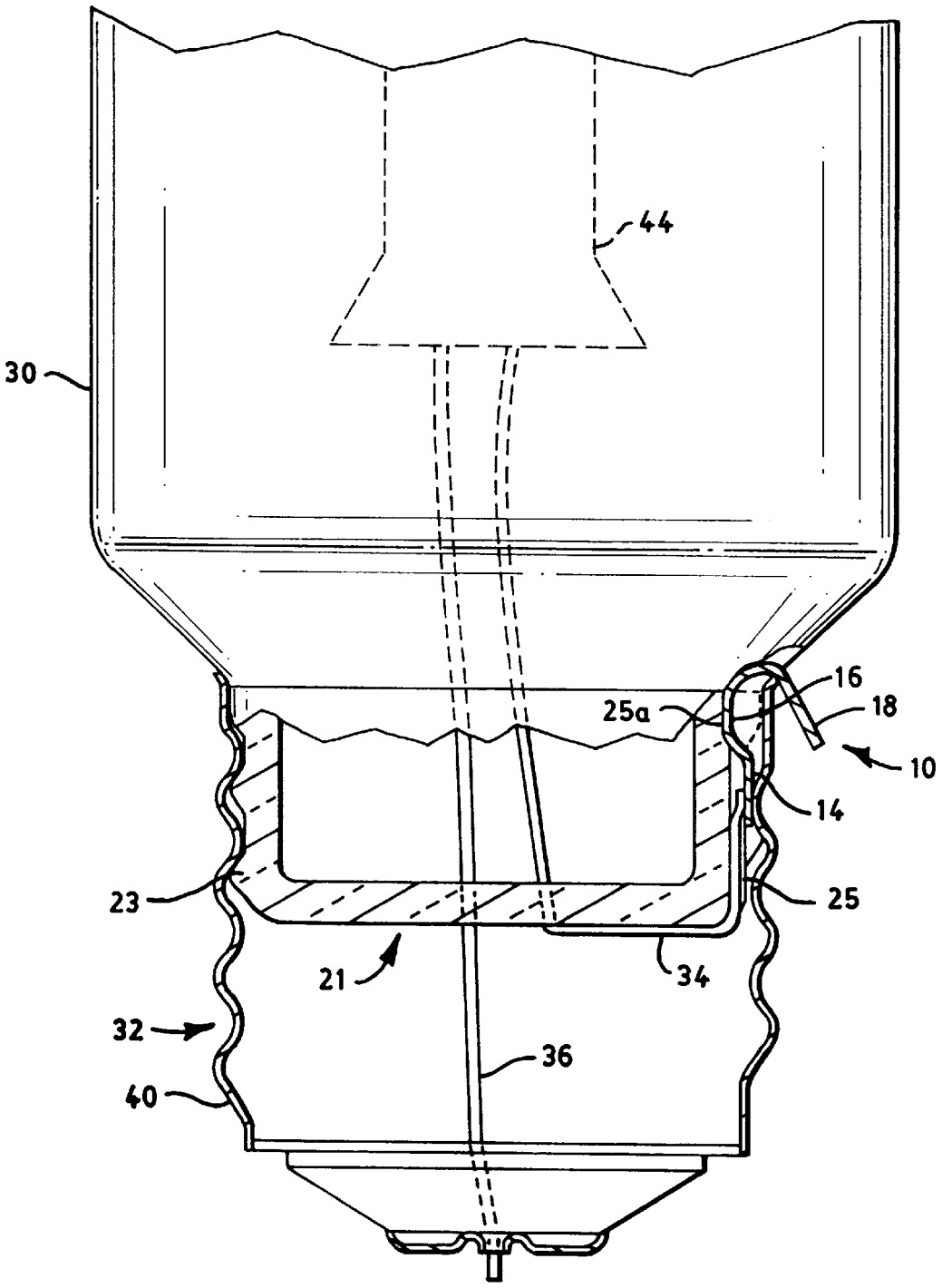
FIG. 4 is an elevational view, partially in section, of the bottom of a lamp with a clip and screw base installed.
Figure 5:
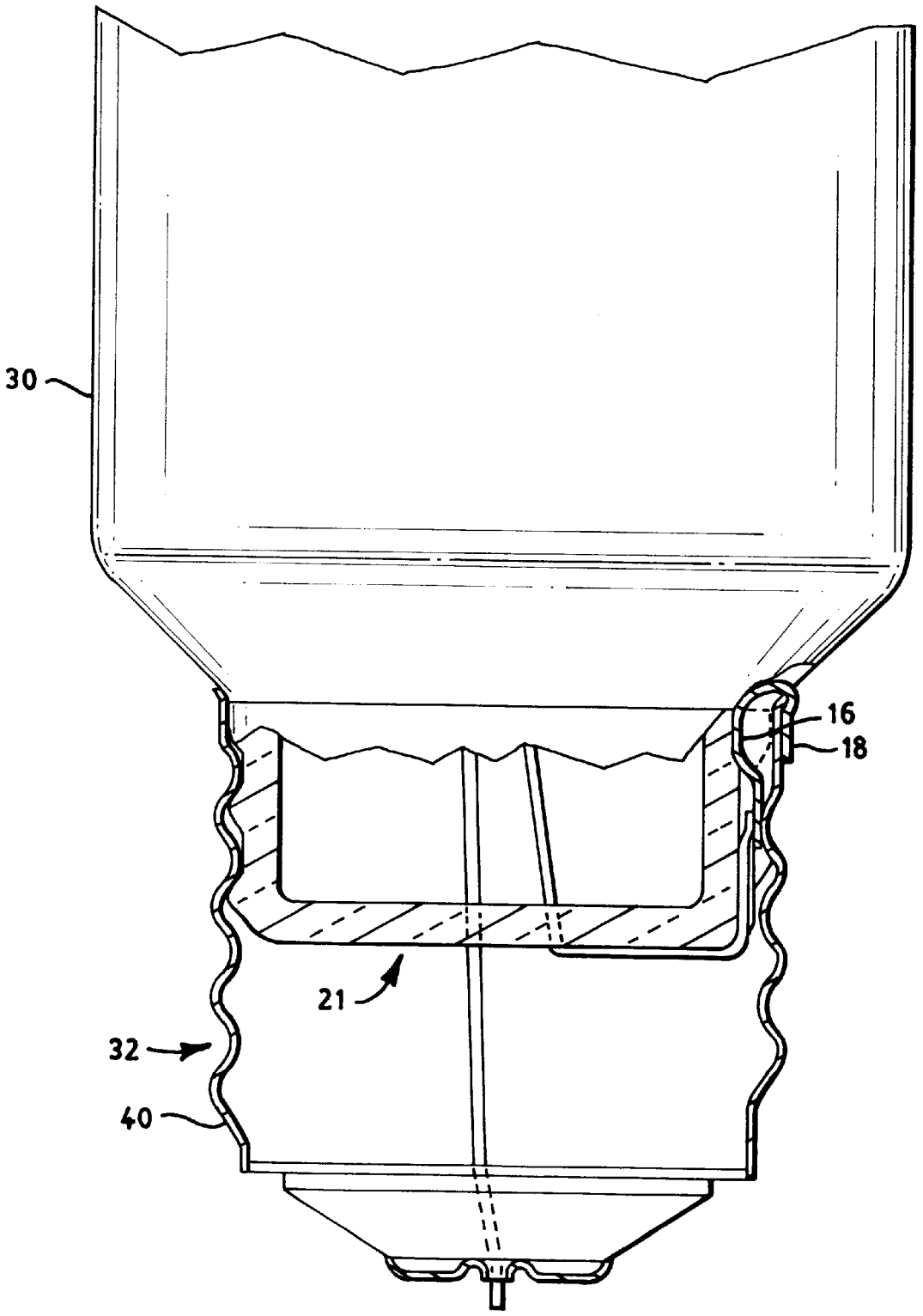
FIG. 5 is a similar view after the assembly and fixation of the clip has been completed.

A lamp base 32 (FIGS. 4 and 5) is threaded onto bottom 21 after locking clip 10 has been attached, as by welding, to a lead-in wire 34, and locking clip 10 has had the middle portion 16 inserted into receiving port 25*a*. The other lead-in wire 36 is attached to the central conductor 38 of base 32. Central conductor 38 is insulated from shell wall 40 of base 32 by a glass insulator 42, as is conventional.

The lead-in wires 34 and 36 extend into the bulb 30 and are electrically connected to a light source 44, which can be an incandescent filament or an arc tube or other light emitting source.

After base 32 is threaded onto bottom 21, end portion 18 is welded to the base 32. The welding operation bends the end portion 18 (aided by the aperture 22) into contact with the base 32 and thus assumes the position shown in FIG. 5, lying parallel to the base and assuring compliance with ANSI specifications concerning protrusion distances.

In a preferred embodiment, the locking clip 10 is fabricated from annealed type 316 stainless steel and has a thickness of 0.010 inches. First portion 14 is also provided with a radius of curvature substantially equal to the radius of curvature of bottom 21, which insures that base 32 will thread easily thereon. The overall length of locking clip 10 is 0.46 inches while the overall depth of scyphate middle portion 16 is about 0.115 inches. The curved edges 50 of middle portion 16 preferably have a radius of 0.090 inches, effectively removing sharp surfaces and greatly reducing stresses that could cause fractures.

While there have been shown and described what are at present considered the preferred embodiments of the invention, it will be apparent to those skilled in the art that various changes and modifications can be made herein without departing from the scope of the invention as defined by the appended claims.

What is claimed is:

1. A locking clip for fixing a base to an end of a glass bulb comprising: a body having a given width and further having a first portion, a middle portion and an end portion, said middle portion being scyphate and defining a plane and extending the full given width of said clip;

said first portion extending away from said plane in a given direction by an angle of about 5 degrees;

said end portion being connected to said middle portion by a reentrant section and extending away from said plane in a direction opposite said given direction by an angle of about 20 degrees.

2. The locking clip of claim 1 wherein the included angle between said first portion and said end portion is between about 25 and 35 degrees.

3. The locking clip of claim 1 wherein said clip has a longitudinal axis, said reentrant section has an extent transverse to said longitudinal axis, and said extent has a centrally located aperture therethrough.

4. The locking clip of claim 1 wherein said glass bulb contains a light source.

* * * * *